United States Patent [19]

Scherer

[11] Patent Number: 4,708,711

[45] Date of Patent: Nov. 24, 1987

[54] PRESSURE CENTRIFUGE

[75] Inventor: Manfred Scherer, Pfaffenhofen, Fed. Rep. of Germany

[73] Assignee: Krauss-Maffei A.G., Fed. Rep. of Germany

[21] Appl. No.: 928,097

[22] Filed: Nov. 7, 1986

[30] Foreign Application Priority Data

Nov. 8, 1985 [DE] Fed. Rep. of Germany ..... 3539694

[51] Int. Cl.[4] ..... B04B 1/20; B04B 15/02; B04B 7/08; B04B 9/00

[52] U.S. Cl. ..... 494/41; 277/15; 277/65; 277/70; 277/81 R

[58] Field of Search ..... 494/13, 38, 41; 277/65, 277/70, 74, 81 R, 15; 415/110, 111, 112, 113, 175; 210/781, 782

[56] References Cited

U.S. PATENT DOCUMENTS 3,315,882 4/1967 Reed ..... 494/15

FOREIGN PATENT DOCUMENTS 1432846 12/1968 Fed. Rep. of Germany .
1432776 12/1969 Fed. Rep. of Germany .
3219686 12/1983 Fed. Rep. of Germany .
3343938 6/1985 Fed. Rep. of Germany .
1346387 2/1974 United Kingdom .

OTHER PUBLICATIONS

"Dekantierzentrifuge KVZ/KVZ S", Krauss-Maffei, date unknown.

*Primary Examiner*—Stuart S. Levy
*Assistant Examiner*—David Werner
*Attorney, Agent, or Firm*—Robert J. Koch

[57] ABSTRACT

A pressure centrifuge with a process chamber enclosed by a pressure housing and a drum and a screw concentrically supported. The connections between the process chamber and the atmosphere are located in the area of bearing supports and provided with rotating mechanical seals. In order to expose the product to be processed in the process chamber to elevated pressures and temperatures a double rotating mechanical seal in the area of the bearing supports between the drum and the screw, which enclose a separate sealing chamber located within a closed cooling and lubricating medium circulation and connected by a connecting channel in the drum and a first rotating passage and a connecting channel in the screw and a second rotating passage with the part of a cooling and lubricating medium circulation located outside the pressure housing.

14 Claims, 2 Drawing Figures

PRESSURE CENTRIFUGE

BACKGROUND OF THE INVENTION

1. Field of the Invention

The invention relates to a pressure centrifuge and more particularly to a multiple drum element decanting centrifuge.

2. Description of the Related Technology

A pressure decanter is shown in a Krauss-Maffei prospectus illustrating the type KVZ/KVZ S decanting centrifuge, 1st edition, Order No. 22 03 d, page 4, where a drum and a screw rotate within a pressurized housing at different rates. Position 2 illustrated in the Figure on page 9 of the aforecited prospectus showns an inner seal between the screw and the drum for sealing the internal space of the housing and the processing chamber, which is under the operating pressure, from the atmosphere. The dry-running rotating mechanical seals are used for sealing the process chamber which is surrounded by the pressure housing, only up to definite limited pressure and temperature conditions.

The sealing action may be improved by lubricating the rotating mechanical seal with lubricating oil used for the bearings. Such lubrication is, however, not feasible when products are processed which must not come into contact with oil leaking from the rotating seal under any conditions.

SUMMARY OF THE INVENTION

It is an object of the invention to equip a pressure centrifuge in a manner such that a product in the process chamber may be exposed to significantly higher pressures and temperatures and a broad variety of medium may be used to cool and lubricate the rotating seals than previously possible. According to the invention, the amount of lubricant/coolant leakage entering the process chamber is compatible with the processed product.

This object is attained by a pressure centrifuge with at least two drum elements rotatingly supported in a process chamber included in a pressure housing and capable of moving relatively with respect to each other. The bearing connections for the drum between the internal space of the housing or the process chamber and the atmosphere are equipped with seals. At least one double seal between the two drum elements is arranged to seal toward the process chamber and the atmosphere. At least the seal closing off the process chamber is a rotating mechanical seal. A separate sealing chamber within the double seal is located within a closed cooling and lubricating medium circulation. The separate sealing chamber is connected by a connecting channel located in one drum element to a first rotating feed sleeve and by a connecting channel provided in the other drum element to a second rotating feed sleeve. Part of the cooling and lubricating circulation may be located outside the pressure housing.

The separate sealing space between two rotating seals is advantageously in fluid communication with the cooling and lubricating circulation loop. The pressure in the sealing space may be adjusted in accordance with a significant increase in the housing or the process chamber internal space pressure, thereby assuring that an adequate volume of cooling and lubricating medium flows through the rotating seal toward the process chamber. A medium compatible with the goods to be processed may be used as the cooling and lubricating circulation. The rotating seals are completely separated from the cooling and lubricating lines for the bearings. The centrifuge may advantageously isolate the roller bearings and bearing lubricants from the process chamber enabling use of bearing lubricant which may not be compatible with the processed products. A leakage return system enables usage of a wet lubricating medium in the cooling and lubricating circulation system.

Additional features which may be incorporated into the invention include a pressure centrifuge which may be arranged within a pressure housing comprising frontal surfaces on the feed and the drive side. The drum elements may be a drum and a screw on a common rotating axle, where the drum is composed of a cylindrical and a conical drum part and is equipped at its ends with hollow shaft journals supported in the frontal surfaces of the pressure housing on the feed and the drive side. The screw may be bearingly supported within said hollow shaft journals and with a rotating mechanical seal provided in a zone between the drum and the screw both on the feed and the drive side. A feed pipe may project through a hollow bore in the journal of the screw on the fill side into the feed distribution space on the frontal surface. A rotating centrifuge drive effecting different rates of revolution between the drum and the screw is arranged on the hollow shaft journal of the drum and the journal of the screw. A double seal enclosing a separate feed side sealing chamber is provided in the zone of the process chamber on the feed side between the screw and the drum. The seal sealing toward the process chamber may be a rotating mechanical seal. A connecting channel is located in the hollow shaft journal on the feed side, said channel branches off with one end from the separate sealing chamber and opens at its other end through a first rotating feeder sleeve into the part of the feed side cooling and lubricating medium circulation located outside the pressure housing. A connecting channel is provided in the journal on the feed side. The channel is connected through a second rotating feeder sleeve to a separate sealing chamber. A double seal enclosing a separate drive side sealing chamber is provided in the zone on the drive side of the process chamber between the screw and the drum. At least the seal sealing toward the process chamber is a rotating mechanical seal. A connecting channel is arranged in the hollow shaft journal on the drive side. The channel branches off with one end from the separate drive side sealing chamber and on the other end opening through a first drive side rotating feeder sleeve into the part of the drive side cooling and lubricating medium circulation located outside the pressure vessel. A connecting channel is provided in the journal on the drive side. The part of a cooling and lubricating medium circulation located outside the pressure housing communicates through a second rotating feeder sleeve with the separate drive side sealing chamber.

The double seal on both the feed and the drive, enclosing a separate sealing chamber, rotating with the drum 4 and the screw 5, may comprise two rotating mechanical seals each.

Each of the first and second rotating feeder sleeves may be double shaft seals cooperating with the hollow shaft journals and journals on the feed and drive sides and enclosing first and second sealing chambers fixedly attached to the housing.

Each of the double shaft seals may be two rotating mechanical seals.

The rotating feeder sleeve to the journal may be a conventional rotating feeder sleeve attached to the frontal side of the journal on the drive side.

The hollow shaft journal and the rotating ring seals facing away from the process chamber of the double seal and a further seal enclose a leakage collector space communicating with the atmosphere by leakage channel provided in the hollow shaft journal and a passage channel leading through the pressure housing.

The leakage collector space and the spaces of the rotating mechanical seals facing away from the first and second sealing chambers may be connected to a leakage return system located outside the pressure housing.

The first and second sealing chambers fixedly attached to the housing may be supplied with separate volumes of the cooling and lubricating medium.

Apparatus may be included to effect a flow of a volume of cooling and lubricating media through the separate sealing chamber.

Means may be provided whereby a pressure gradient may be obtained to effect a flow through the separate sealing chamber between the first and the second sealing chambers and fixedly attached to the housing rotating with the drum and the screw.

The means to produce a pressure gradient may comprise a throttle located in a feed line for the first sealing chamber fixedly attached to the housing, with the feed line branching off from a feed line for the cooling and lubricating media supplying the second sealing chamber fixedly attached to the housing.

The pressure centrifuge according to the invention enables the cooling and lubricating medium circulation to cool and lubricate the double seal. The first and second rotating passages are separated from the cooling and lubricating medium circulations for other operating elements of the pressure centrifuge, such as for example the bearings.

A feature of the invention is that the lubricating media used in the supporting bearings can be isolated from the process chamber. The cooling and lubricating medium used in the double seals may advantageously be compatible with material in the process chamber. Features of the invention enable pressure regulation of both the process chamber and double seal lubricant without danger of contaminating the process chamber with bearing seal lubricant.

BRIEF DESCRIPTION OF THE DRAWINGS

An embodiment of the invention is described below with reference to the drawings. In the drawings:

FIG. 1 shows a schematic view of a decanting centrifuge 1. The centrifuge comprises a pressure housing 2 including a process chamber 3 in which a drum 4 and a screw 5 are arranged on a common horizontal axle.

Figure 1:
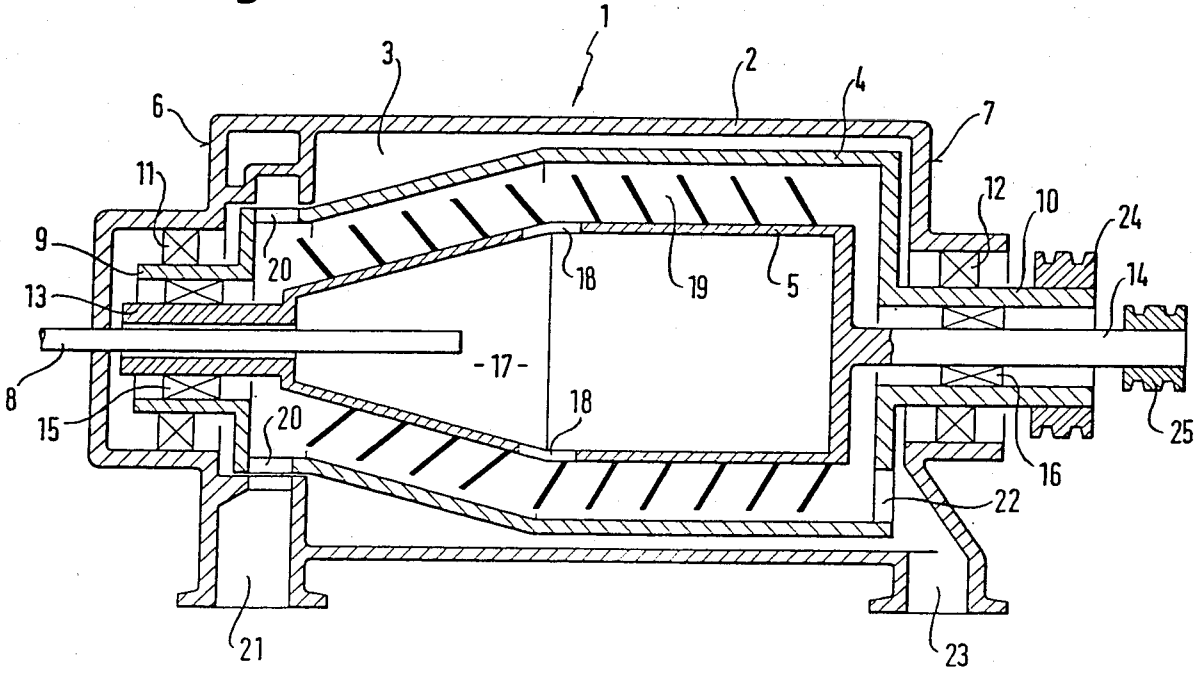
FIG. 1 shows a schematic sectioned view of a pressurized decanting centrifuge.

The pressure housing 2 comprises a frontal surface 6 on the feed side and a frontal surface 7 on the drive side. A feed pipe 8 projects through the frontal surface 6 into the process chamber 3 and is mounted in a stationary manner. The drive elements for the drum 4 and the screw 5 are arranged on the drive side frontal surface 7.

The drum is bearingly supported in roller bearings 11 and 12 by hollow shaft journals 9, 10 in the frontal surface 6 on the feed side and the drive side 7 respectively.

The screw is mounted in additional roller bearings 15 and 16 by journals 13 and 14 in the frontal surfaces 6 and 7 on the feed side and the drive side, respectively, within the two hollow shaft journals 9 and 10.

The drum 4 exhibits a cylindrical and a conical part. The screw 5 is supported inside the drum 4. The feed pipe 8 projects into the interior of the screw 5. The pipe is stationarily mounted on the housing. The internal space of the screw defines a feed distributor 17. A suspension is introduced into the feed distributor 17 through the feed pipe 8. A separation chamber 19 is defined by the space between the drum 4 and the screw 5. Material is transmitted into the separation chamber through outlet orifices 18.

Outlet orifices 20 for solids are located in a conically tapering end of the drum 4. The orifices 20 are axially aligned with solids trap 21 fixedly mounted on the housing. A plurality of liquid outlet orifices 22 are arranged in the end of the drum 4 opposite the solids outlet orifices 20. A liquid drain channel 23 fixedly attached to the housing is associated with the liquid outlet orifices 22.

The hollow shaft journal 10 and the journal 14, on the drive side, are equipped with V-belt pulleys 24 and 25. The drum 4 and the screw 5 may be driven at centrifugal rates. A difference in rotational velocity is normally maintained between the drum and the screw.

Figure 2:
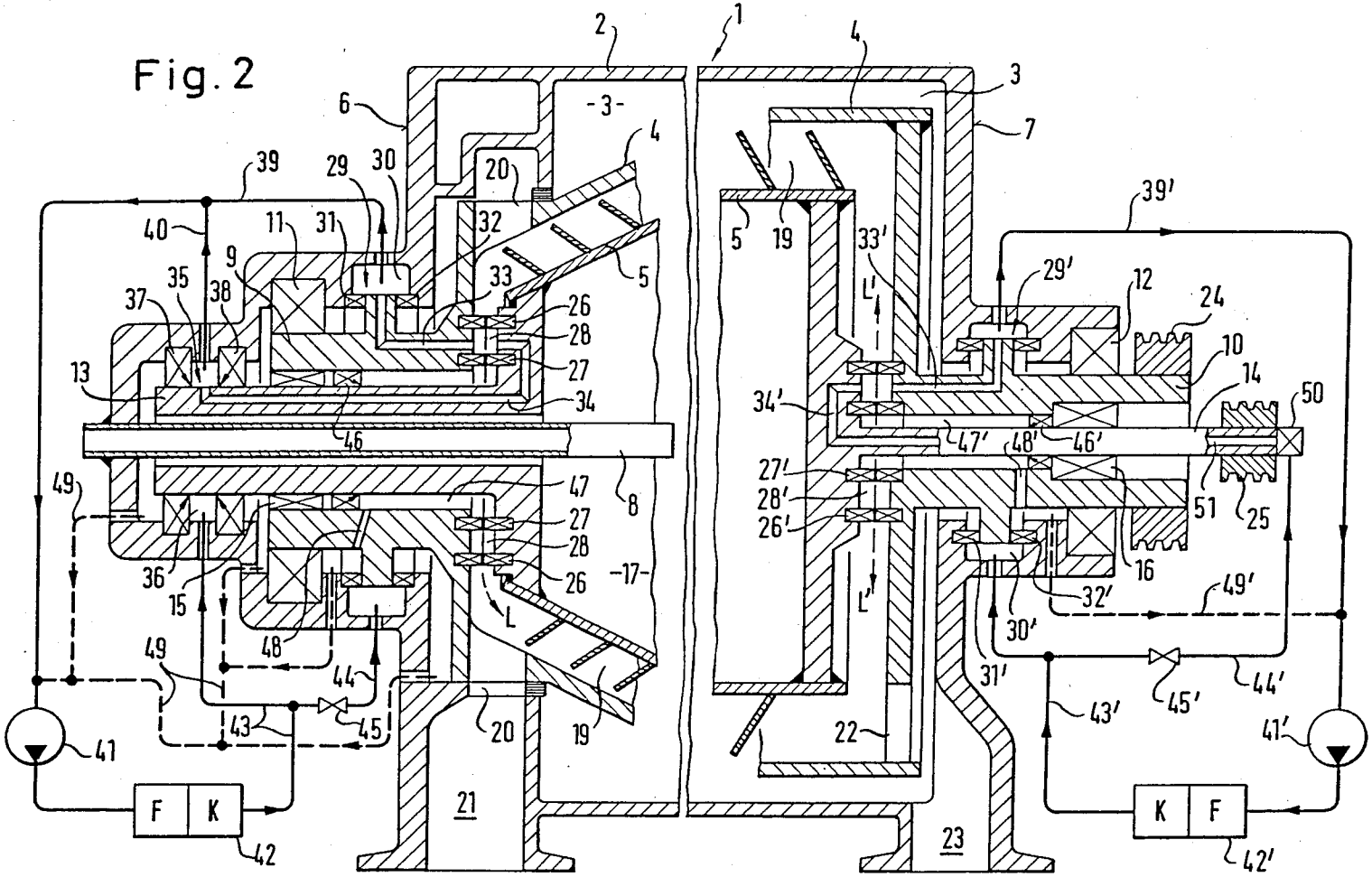
FIG. 2 shows the two end zones of a decanting centrifuge according to FIG. 1 in a detail view.

FIG. 2 shows a detail view of the feed and drive side areas of the decanting centrifuge of FIG. 1.

There is a double seal between the screw 5 and the drum 4 made up of rotating seals 26 and 27 facing the process chamber 3, and the atmosphere outside the housing respectively. A separate feed side sealing space 28 is defined between rotating seals 26 and 27.

The separate sealing space 28 on the feed side is a portion of a closed cooling and lubricating circulation or system located only partially within the pressure housing 2.

The part of the cooling and lubricating system located inside the pressure housing 2 includes a first rotating feeder sleeve 29 associated with the hollow shaft journal 9 on the feed side. The sleeve 29 is formed by a first pressure chamber 30 fixedly attached to the housing and two rotating seals 31, 32 acting on the hollow shaft journal 9. A connecting channel 33 arranged in the feed side hollow shaft journal leads from the rotating feeder sleeve 29 to the separate sealing chamber 28.

A connecting channel 34 leads from the sealing space 28 through the journal 13 to a second rotating feeder sleeve 35 formed by a second pressure chamber fixedly mounted on the housing. Two rotating seals 37, 38 act on the journal 13.

The part of the cooling and lubricating circulation loop located outside the pressure housing 2 is connected to the first and second pressure chambers 30, 36. The circulation loop is laid out so that the first rotating feeder sleeve 29 and the second rotating feeder sleeve 35, are supplied with a separate circulating volume. A pressure gradient is established between the first pressure chamber 30 and the second pressure chamber 36, both fixedly mounted on the housing, whereby the circulation of a partial volume of the cooling and lubricating medium through the part of the cooling and lubricating circulation loop located inside the pressure housing 2 is assured. In the cooling and lubricating medium circulation shown in FIG. 2, return lines 39 and 40 branch off from the first and second pressure chambers 30, 36 and are combined in front of a pump 41. A filter and cooling unit 42 is arranged in the transport direction following the pump. The cooled and filtered cooling and lubricating medium is returned through the feed lines 43 and 44 into the two pressure chambers 30 and 36 on the housing.

A pressure gradient is established between the second and the first pressure chambers 36 and 30 by a throttle 45 in the feed line 44 to effect a circulation of a partial volume of the cooling and lubricating medium through the part of the cooling and lubricating medium circulation located inside the pressure housing 2, wherein the pressure is high enough so that a higher pressure level is attained in the separate sealing chamber 28 on the feed side than in the process chamber 3, whereby a constant flow (arrow L) through the rotating seal 26 facing the process chamber 3 is assured by a functionally necessary leakage volume.

Any lubricant suitable for the cooling and lubrication of the rotating seals 26, 27, 31, 32, 37, 38 and compatible with the products to be processed may be used for the rotating seals 26, 27, 31, 32, 37, 38 of the first and second rotating feed sleeve 29, 35 and the rotating seals 26, 27 of the double sealing because of the closed circulation of the cooling and lubrication loop. It is not necessary that the lubricant be also suitable for the bearings 11, 12, 15, 16.

The cooling and lubricating medium which looks through the rotating seals 26, 27, 31, 32, 37, 38, other than the leakage into the process chamber 3, is collected and returned to the cooling and lubricating medium circulation system. It may be necessary to provide a seal 46 between the journal 13 and the associated hollow shaft journal 9 on the feed side. The seal 46 and the rotating seal 27 facing away from the process chamber 3 define a leakage collecting space 47. The leakage may be conducted from the collecting space 47 through a leakage channel 48 located in the hollow shaft journal 9 and into the leakage return system 49 (shown by broken lines). All of the spaces of, or areas beyond, the rotating seals 27, 31, 32, 37, 38 are connected with the leakage return system 49, with the exception of the rotating seal 26 facing the process chamber 3. The leakage return system 49 is combined into a single line and opens into the return lines 39, 40 in front of the pump 41.

The drive side zone of the decanting centrifuge exhibits cooling and lubricating circulation system and seals essentially identical to, and acting in a similar manner as, circulation on the feed side. The drive side differs slightly from the system on the feed side. A conventional rotating feed sleeve 50 is provided on the grontal side of the journal 14 on the drive side, and the journal 14 of the screw is equipped with a hollow bore 51.

In FIG. 2, parts on the drive side corresponding to the feed side equivalents are identified by the index'.

In the state-of-the-art operation of decanting centrifuges, the simple dry-running rotating seals located between the drum and the screw to seal off the process chamber against the atmosphere set the limit for the pressures and temperatures used in the process chamber. This limit is approximately 3 bar and 130° C.

According to the state of the art, a further limitation is set. Only products compatible with the lubricant passing through the leakage flow into the product may be processed if lubricants are used for the rotating seals. Furthermore, the cooling and lubrication leakage flow functionally necessary for lubricated rotating seals cannot be assured in the direction of the process chamber in the case of elevated pressures in the process chamber.

In the operation of the decanting centrifuge according to the invention, a pressure may be established in the separate sealing chambers 28 on the feed and the drive side, whereby the flow of the cooling and lubricating media through the rotating seal surfaces in the direction of the process chamber may be assured.

In this manner, for example, in case of a pressure level of 11 bar in the two separate pressure chambers of a decanting centrifuge according to the invention, a pressure of 10 bar and a temperature of 180° C. may be set in the pressure chamber.

By virtue of the essentially closed circulation of the cooling and lubricating medium, any substance suitable as a cooling and lubricating medium for rotating seals and compatible with the product maybe used. It is not necessary that it be also suitable as a lubricant for the bearings of the journals of the drum and the screw. Thus, for example, in the processing of suspensions containing plastics, water may be used for the rotating seals, which in contrast to, for example, lubricating oil, is compatible with plastics.

The invention is not restricted to pressure centrifuges such as a decanting centrifuge where relative motion is produced by different rates of revolution of the drum and the screw. The invention is applicable in principle to other pressure centrifuges in which relative motion of the drum elements revolving in a pressure housing is created by an axial counter movement as, for example, in a pusher centrifuge where the pusher ram revolves at the rate of the centrifuge drum moved by axial displacement relative to the centrifuge drum. In this case, two axially spaced apart rotating mechanical seals may be located on the hollow shaft journal of the centrifuge drum, which are rotatingly abutting against an axial and cylindrical journal of the pusher ram and include a separate sealing chamber that may be connected by channels provided in the shaft journal and the hollow shaft journal and rotating feed sleeves with a closed cooling and lubricating circulation.

I claim:

1. A pressure centrifuge comprising:

a pressure housing;

a first rotating drum element bearingly mounted at first bearing zones within said pressure housing;

a first seal between said first rotating drum element and said pressure housing at said first bearing zones;

a second, independently rotating drum element, bearingly mounted at second bearing zones, within said first drum element;

a second seal between said first drum element and said second drum element at said second bearing zones;

a double seal between said first and second rotating drum elements arranged between said second seal and an internal process chamber, and exhibiting an internal and external seal element, wherein said internal seal element is a rotating mechanical seal;

a separate sealing chamber defined between said internal and external seal elements;

means for cooling and lubricating said double seal including a circulation loop comprising means for connecting a first rotating feed sleeve disposed in said first drum element to said separate sealing chamber and means for connecting a second rotating feed sleeve disposed in said second drum element to said separate sealing chamber.

2. A pressure centrifuge according to claim 1, wherein said first and second drum elements are coaxially arranged and each exhibit a cylindrical portion and a conical portion;

said first and second drum elements exhibit axial support journals, supported at a pressure housing feed side and a pressure housing support side;

said centrifuge further comprising:

pipe means for feeding material into a feed distribution space defined by an internal area of said second rotating drum, extending through a hollow shaft support journal of said second drum element at said pressure housing feed side;

means for driving said first and second drum elements connected to said support journals at said pressure housing drive side.

3. A pressure centrifuge according to claim 2, wherein both said pressure housing feed and drive sides exhibit first seals, second seals, and double seals; and wherein said means for connecting a first rotating feed sleeve is a channel in said first drum element support journals and said means for connecting a second rotating feed sleeve is a channel in said second drum element support journals.

4. A pressure centrifuge according to claim 3, wherein the double seal on both the pressure housing feed and drive sides comprises two rotating mechanical seals each.

5. A pressure centrifuge according to claim 4, wherein said first and second rotating feeder sleeves comprise double shaft seals cooperating with said first drum element shaft journals and second drum element journals on the feed and drive sides and enclosing first and second sealing chambers fixedly attached to the housing.

6. A pressure centrifuge according to claim 5, wherein each said double shaft seal comprises two rotating mechanical seals.

7. A pressure centrifuge according to claim 4, further comprising a conventional rotating feeder sleeve axially attached to the frontal side of the journal on the pressure housing drive side.

8. A pressure centrifuge according to claim 6, wherein said support journals and said external seal elements define a leakage collector space; and further comprising a leakage channel disposed in said first drum element support journal connected to said leakage collector space and a passage channel leading through the pressure housing in communication with said passage channel.

9. A pressure centrifuge according to claim 8, further comprising a leakage return system associated with said leakage collector spaces and connected to additional leakage collector spaces associated with said first and second rotating feed sleeves.

10. A pressure centrifuge according to claim 9, further comprising means for supplying separate volumes of cooling and lubricating medium to a first and second sealing chamber defined by said first and second feed sleeves respectively.

11. A pressure centrifuge according to claim 10, further comprising means for effecting a flow of a volume of cooling and lubricating media through said separate sealing chambers.

12. A pressure centrifuge according to claim 11, further comprising means for effecting media flow through said separate sealing chamber by inducing a pressure gradient between said first and second sealing chambers.

13. A pressure centrifuge according to claim 12, further comprising:

a first media feed line connected to said first sealing chamber;

a second media feed line connected to said second sealing chamber and said first media feed line; and wherein said pressure gradient is caused by a throttle disposed in said first media feed line.

14. A pressure centrifuge according to claim 3, further comprising:

means for separating cooling and lubricating media circulating through said separate sealing chamber from lubricating media for said first and second seals.

* * * * *